United States Patent [19]

Zaikovsky et al.

[11] 4,050,288

[45] Sept. 27, 1977

[54] DIE FOR EXTRUDING ARTICLES WITH VARIABLE CROSS-SECTION PROFILE

[76] Inventors: Vladimir Borisovich Zaikovsky, ulitsa Mishina, 12, kv.19; Jury Prokhorovich Kutuzov, ulitsa Gvardeiskaya, 1, kv.90; Mikhail Fedorovich Zakharov, ulitsa Tolbukhina, 12, Kv.19, all of Moscow; Evgeny Emelyanovich Kavtaev, ulitsa Karla Marxa 3, kv.34, Verkhnaya Salda Sverdlovskoi oblasti; Jury Grigorievich Poedinschikov, ulitsa Karla Libknekhta, 8, kv.1, Verkhnaya Salda Sverdlovskoi oblasti; Jury Mikhailovich Bazhanov, ulitsa Karla Libknekhta, 12, kv.11, Verkhnaya Salda Sverdlovskoi oblasti; Valentin Andrianovich Schapov, ulitsa Vostochnaya, 12, kv.10, Verkhnaya Salda Sverdlovskoi oblasti, all of U.S.S.R.

[21] Appl. No.: 678,885

[22] Filed: Apr. 21, 1976

[51] Int. Cl.[2] ..... B21C 3/06

[52] U.S. Cl. ..... 72/468

[58] Field of Search ..... 72/468, 264

[56] References Cited

U.S. PATENT DOCUMENTS

| | | | |
|---|---|---|---|
| 2,740,635 | 4/1956 | O'Toole | 72/468 X |
| 3,178,770 | 4/1965 | Willis | 72/468 X |

*Primary Examiner*—Milton S. Mehr

*Attorney, Agent, or Firm*—Lackenbach, Lilling & Siegel

[57] ABSTRACT

A die for extruding articles with a variable cross-sectional profile comprises two components which form a hole of the die. One said component is rigid, and the other is provided in the form of a movable member adjusted so that it can turn around its axis. The periphery of this member represents by itself a profiled surface. The design of such a die is sufficiently simple and reliable in operation and the die ensures manufacturing of articles with a cross-sectional profile changeable over on a wide range.

4 Claims, 2 Drawing Figures

DIE FOR EXTRUDING ARTICLES WITH VARIABLE CROSS-SECTION PROFILE

Figure 2:
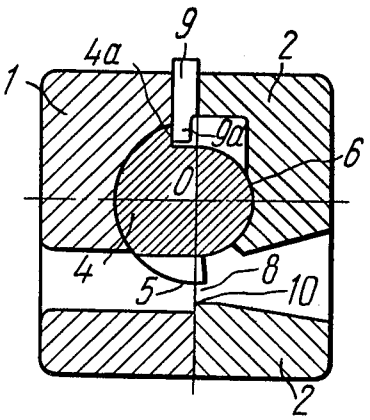

The present invention relates to shaping of metals by pressure and, more specifically, to dies for extruding articles with a variable cross section profile.

The present invention can be most successfully employed for extruding panels and shapes with a cross section changeable as to its length, which panels and shapes are required by various industries.

At present there is an increased demand for articles with a variable cross-section profile, expedially in the aircraft industry where their use results in a considerable reduction in weight of the structure of an aircraft. Such articles can be used instead of similar items usually manufactured from forged and rolled plates by means of milling.

Known in the art is a die for extruding articles with a variable cross-section profile. Such a die comprises two components which form a hole of the die. One said component is rigid and the other component, with a profiled surface, is adjusted and displaced in the direction of extruding to effect changing of the cross-section profile of the die's hole and, consequently, the cross section of an article.

The die also comprises a lock provided in the form of a wedge, which lock interacts with the movable component to hold it from being displaced. After said lock stops interacting with the movable component the latter is displaced, altering the cross section of the die's hole.

The main shortcoming of such a die is that it can be used for manufacturing an article with only one alteration in its cross-section profile.

Besides, since the magnitude of displacement of the movable component of said die cannot be changed in the process of extruding an article, the lengths of said article's parts with different cross sections, which article is extruded through in such a die, are constant and cannot be altered in the process of extrusion.

Another shortcoming of said known die is the need for its time-consuming readjustment, carried out after extruding of every article, and which readjustment provides for cleaning of the hot die from metal left in it and for displacement of the movable component in its initial position.

It is therefore the principal object of the present invention to provide a die for extruding articles with a variable cross-section profile, with the component thereof, having a profiled surface, accomplished so as to ensure extruding articles with a cross-section profile changeable over a wide range. In addition, the design of such a die is considered of the type which is simple in construction and very reliable in operation.

This object is achieved by a die for extruding articles with a variable cross-section profile, which die comprises two components, forming the die's hole; of which one is rigid, and the other, with a profiled surface, is adjusted with a possibility of being displaced to effect changing of the cross-section profile of the die's hole. In accordance with the invention, the component of the die with said profiled surface is provided in the form of a member adjusted so that it can turn around its axis, and the periphery of which member represents by itself said profiled surface.

The die, made according to the present invention, enables obtaining articles with a cross-section profile changeable on a wide range.

Besides, in the process of extruding of one article, the lengths of its parts, having different cross sections, can be changed.

The die has a simple design solution, is fool-proof in its technology and reliable in operation.

Articles obtained with the help of such a die require less expenditure of time on their subsequent machining, which makes their manufacture considerably more economical.

Figure 1:
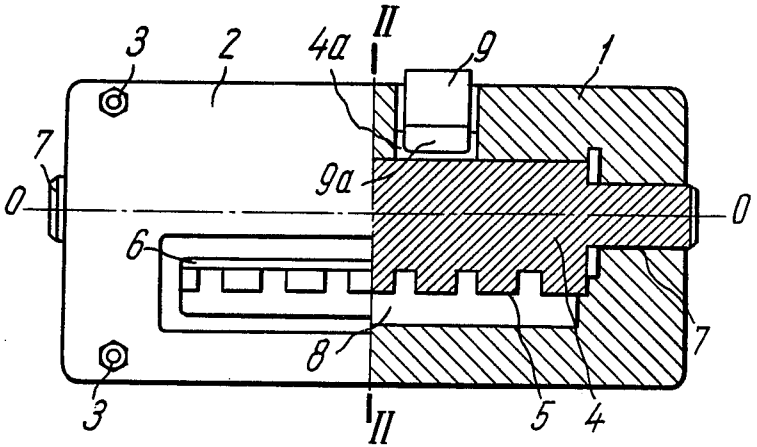

The above features and other advantages of the invention will be clear from the following description of the preferred embodiment thereof, when read in conjunction with the accompanying drawings, in which:

FIG. 1 a side elevational view of a die for extruding articles with a variable cross-section profile, according to the invention, with a longitudinal portion of same shown in section;

FIG. 2 is a sectional view, taken along the line II—II of FIG. 1.

The die made according to the present invention comprises a bearing component 1 (FIGS. 1,2), with a rigid component 2 mounted thereon and secured thereto with bolts 3 (FIG. 1). The The die also comprises a component 4 (FIGS. 1 and 2) representing by itself a member adjusted so that it can turn around its axis 0—0, the periphery thereof being a profiled surface comprising a portion 5 with a larger radius in a cross section as is shown in FIG. 2, and a portion 6 with a smaller radius. This component 4 is arranged between the bearing component 1 and the rigid component 2 and rests upon them with its journals 7 (FIG. 1) provided on butt ends of the component 4. The components 2 and 4 form a hole 8 (FIGS. 1, 2) of the die; the cross-section profile of said hole is changed when the component 4 is turned in the process of extrusion.

The die also comprises a lock 9 which can be of any design suitable for the purpose. By its end **9*a*, the lock 9 rests against a protrusion 4*a* provided on the component 4, thus preventing the component 4** from being turned.

Manufacturing of articles with a variable cross-section profile by means of the die, made according to the present invention, is accomplished in the following way.

In the process of extrusion a blank, metal enters into the die's hole 8 formed by the portion 5 of the profiled surface of the die's movable component 4 and a profiled surface 10 (FIG. 2) of the die's rigid component 2.

With such position of the profiled surfaces in the hole 8 of the die, there is shaped one part of an article, having a smaller cross section formed in the hole 8 of the die.

As soon as this part of the article is extruded to a required length, the lock 9 stops interacting with the component 4, this interaction being discontinued manually or by a lever mechanism, or by an automatic servo-system. With the help of mechanical means or by hand the component 4 is turned clockwise so that the portion 6 of the profiled surface of the die's component 4 is positioned opposite the profiled surface 10 of die's rigid component 2, forming the hole 8 with another cross-section profile. Then in the hole 8 of the die there is shaped a part of the article, which part has a bigger or thicker cross section. As soon as this part of the article is extruded to a required length, the extrusion of said article is over.

In other possible embodiments of the invention, the movable component of the die can have a greater number of said portions of the profiled surfaces, which enables obtaining articles with a more complicated cross-sectional profile, such as one having increasingly bigger or thicker cross-sections.

Then the component 4 of the die is turned mechanically or by hand counter-clockwise in its initial position and is held from being turned by said lock 9.

After that the extrusion cycle is repeated.

An experimental model of the die has undergone trials or tests which have proved it is possible to obtain, with the help of such a die, articles with a cross-sectional profile, changeable over a wide range with regard to their parts or portions of a different length.

The experimental model of the die was utilized for extruding profiled panels having a width from 150 to 800 mm made from aluminum alloys whose characteristics met the requirements requisite for panels of such a type.

Panels squeezed with the help of such a die require minimum machining.

What we claim is:

1. An extruding die for extruding articles with a variable cross-sectional profile, comprising: a stationary bearing component; a pair of components mounted on said bearing component and together forming a hole or aperture for said extruding die; one of said components is rigidly mounted on said bearing component; and the other of said components is rotatably mounted opposite said rigidly mounted component, and is provided in the form of a component with a periphery representing by itself a variable profiled surface, and rotatable component is adjusted to a predetermined profile by rotation about its axis to effect changing of the cross-sectional profile of said aperture or hole of said die.

2. The extruding die according to claim 1, including a releasable stop for locking in place said rotatably mounted component.

3. The extruding die according to claim 1, wherein said rotatably mounted component is provided with a plurality of profiled surfaces.

4. The extruding die according to claim 1, wherein said variable profiled surface of said rotatably mounted component has two cross-sectional profiles.

* * * * *